United States Patent [19]

Vallee

[11] 4,079,561

[45] Mar. 21, 1978

[54] METAL ROOFING SHINGLE

[76] Inventor: Louis Leonce Vallee, 6392 Maugourg, Montreal, Quebec, Canada

[21] Appl. No.: 789,730

[22] Filed: Apr. 21, 1977

[30] Foreign Application Priority Data

May 6, 1976 Canada ..... 251931

[51] Int. Cl.[2] ..... E04D 1/00; E04B 7/00

[52] U.S. Cl. ..... 52/529; 52/94; 52/520; 52/530; 52/588; 52/619

[58] Field of Search ..... 52/529, 519, 528, 530, 52/404, 619, 532, 536, 551, 554, 556, 531, 94, 520, 538, 543, 527, 545, 521, 96, 588

[56] References Cited

U.S. PATENT DOCUMENTS

| | | | |
|---|---|---|---|
| 313,853 | 3/1885 | Cortright | 52/529 |
| 1,436,945 | 11/1922 | Clifton | 52/530 |
| 1,470,837 | 10/1923 | Hofstatter | 52/94 X |
| 1,513,800 | 11/1924 | Brydle | 52/529 |
| 1,585,987 | 5/1926 | Hennessy | 52/94 |
| 1,597,993 | 8/1926 | Meurer | 52/529 |
| 1,968,217 | 7/1934 | Modffit | 52/94 |
| 2,601,833 | 7/1952 | Olsen | 52/94 |
| 3,371,457 | 3/1968 | Wienand | 52/530 X |
| 3,381,426 | 5/1968 | Heidrich | 52/96 |
| 4,014,152 | 3/1977 | Vallee | 52/528 X |

FOREIGN PATENT DOCUMENTS

| | | | |
|---|---|---|---|
| 583,137 | 10/1958 | Italy | 52/96 |

*Primary Examiner*—Ernest R. Purser
*Assistant Examiner*—Robert C. Farber
*Attorney, Agent, or Firm*—Fetherstonhaugh & Company

[57] ABSTRACT

Metal roofing shingles including triangular shaped gable and eave starting shingles and square or rectangular shaped shingles covering the main body of the roof, the shingles being laid in courses whereby their edges run at an angle from the gable ends and eave edges upwards towards the ridge of the roof and under a ridge cap. Each of the shingles is secured to the underlying roof structure by a roofing nail passing through the uppermost corner of the shingle. The lowermost edges of the shingles are interlocked over and under the uppermost edges of adjacent shingles and have their lowermost corners overlapping the uppermost roofing nail secured corner of adjacent shingles. The edges of the triangular shaped shingles adjacent to the gable ends and eave edges of the roof are folded under and inwards in locking engagement with folded protruding edges of gable and eave starter lengths of formed sheet material which have been secured to the gable end and eave edges of the underlying roof structure. The ridge cap covering the upper portions of the shingles is in two longitudinal parts, the under part being secured by roofing nails passing through theunderlying shingles to the underlying roof structure. The upper part of the ridge cap has inturned lower edges which slidingly engage with folded over edge portions of the under part of the ridge cap.

15 Claims, 17 Drawing Figures

METAL ROOFING SHINGLE

The present invention relates to roof coverings of the shingle type and particularly shingles formed from metal or plastic sheet material.

It has been known to form shingles or tiles of sheet material having folded over egde portions adapted to interlock with each other to form roof coverings. However, such shingles or tiles have failed to provide complete weatherproof protection, particularly at the corners where the folded over edge portions meet leaving a slot which is only partially covered by the shingle or tile in the next above row. A slight wind is all that is required to drive water on the exposed surface of the shingle or tile up and through the exposed slot, subsequently to leak through the underlying roof structure. This is particularly so where the shingles or tiles are staggered relative to each other as the rows progress upwards on the roof. Examples of such exposed slots and staggered setting of the shingles or tiles are seen in U.S. Pat. Nos. 1,436,945 to R. K. Clifton and U.S. Pat. No. 3,371,457 to M. Wienand. In addition, such forms of shingles or tiles have excessive overlap at the corners resulting in the use of excessive amounts of material. Furthermore, these known forms create difficulty and additional expense in the hand work required in the cutting and setting of the starting shingles or tiles at the eave and gable edges of the roof, particularly so where the shingles or tiles are staggered as the rows progress upwards on the roof.

The present invention avoids the disadvantages of known forms of shingles or tiles made from sheet material and consists of three basic forms, including main square or rectangular forms and triangular forms of eave and gable end starter shingles, interlocked with each other so that their edges form continuous lines running from the eave and gable ends of the roof at an angle of 45° right up to a ridge cap at the roof ridge, with no exposed slots at the mating corners of the shingles. Gable and eave starter lengths of sheet material provide a solid basis for the start of the roof covering and the triangular form of eave and gable starter shingles are provided with edge portions which are bent down and under the starter lengths, thus holding the shingles against lifting due to wind force and the leakage of water. A ridge cap consisting of a bottom member having upwardly and inturned longitudinal edges is secured over the uppermost shingles and an upper member, having downwardly and inturned longitudinal edges, is slidable longitudinally over the bottom member to seal the roof area on either side of the ridge of the roof.

The primary object of the invention is to provide a shingle or tile type roof covering which will be completely weatherproof and resistant to wind forces.

A further object of the invention is to provide a shingle or tile type roof covering in which the main body of shingles or tiles are square or rectangular, and the eave and gable shingles or tiles are triangular and all are interlocked with each other and with the eave and gable starter strips to secure the roof covering against wind forces and leakage of water to the underlying roof structure.

A further object of the invention is to provide a shingle or tile type roof covering in which the exposed edges of the shingles or tiles have a continuous line running from the eave and gable ends at 45° upwards towards the ridge of the roof. A further object of the invention is to provide a shingle or tile type roof covering in which the corner overlaps adjacent shingles or tiles have no exposed gaps or slots and corner overlaps conceal the shingle nail head securing each shingle or tile.

These and other objects and advantages of the present invention will be apparent from the following detailed specification and the accompanying drawings in which:

FIG. 1 is a perspective view of one end area of a roof partly in section, showing the roof covering according to the present invention.

FIG. 1*a* is a perspective view similar to FIG. 1, showing rectangular shingles particularly for use at the finishing end of the roof shingle assembly.

FIG. 2 is a plan view of the sheet from which the main square or rectangular shingles of the roof are cut before forming.

FIG. 2*a* is a top plan view of the shingle, folded and formed from the sheet shown in FIG. 2.

FIG. 3 is a plan view of the sheet from which the eave starter shingles are cut before forming.

FIG. 3*a* is a top plan view of the triangular eave starter shingles, folded and formed from the sheet shown in FIG. 3.

FIG. 4 is a plan view of the sheet from which the gable starter shingles are cut before forming.

FIG. 4*a* is a top plan view of the left hand triangular gable starter shingles, folded and formed from the sheet shown in FIG. 4.

FIG. 4*b* is a top plan view of the right hand triangular gable starter shingles folded and formed from the sheet shown in FIG. 4.

Figure 1:
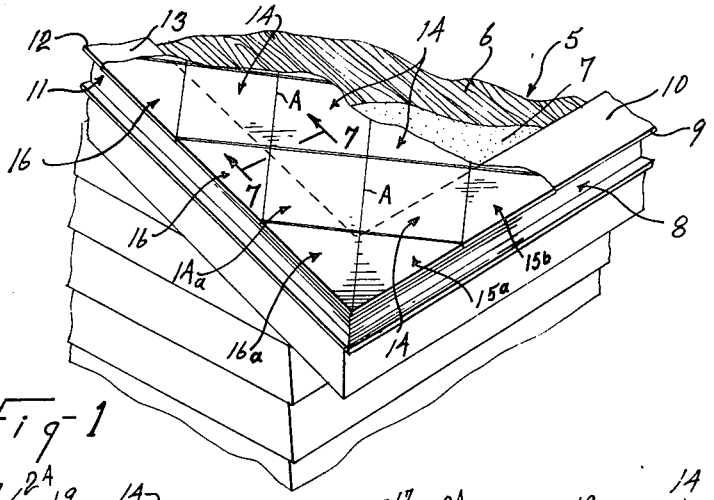

Referring to the drawings, the underlying roof 5 of the building includes a wooden roof structure 6 which is covered by a layer of waterproof material such as tar paper 7.

The lower eave edges of the roof 5 are provided with an eave starter strip 8 of sheet metal, having a folded over edge protrusion 9 projecting outwardly from the flat portion 10 which is secured to the lower portion of the roof 5, and the gable end portions of the roof 5 are provided with a gable starting strip 11 of sheet metal, also having a folded over edge protrusion 12 projecting outwardly from the flat portion 13 which is secured to the gable end portions of the roof 5.

The roof covering consists of three forms of shingles or tiles formed from sheet metal material, generally square shaped shingles 14 covering the main area of the roof 5, triangular shaped eave starting shingles 15 and triangular shaped gable starting shingles 16. The shingle 16*a*, shown in FIG. 4*a* is for installation at the left hand gable end of the roof, while the shingle 16*b* shown in FIG. 4*b* is for installation at the right hand gable end of the roof.

Figure 2:
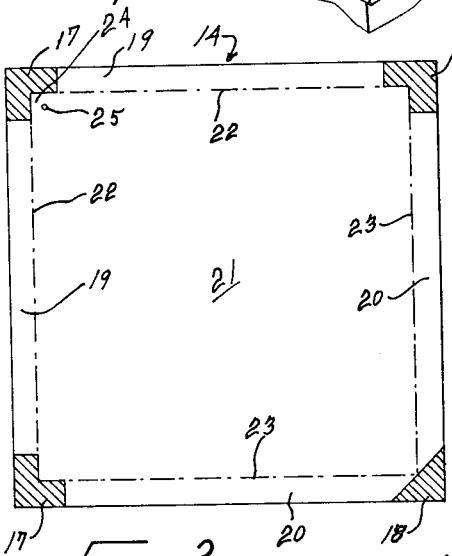
Figure 2A:
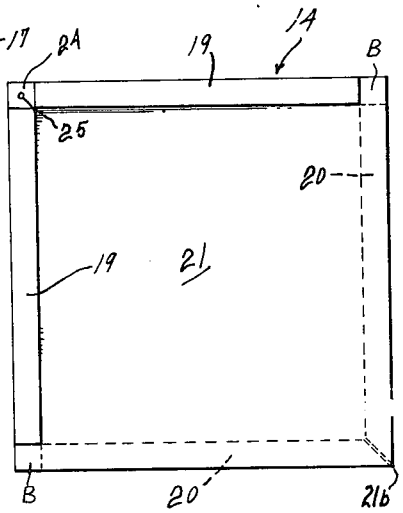

The generally square shaped shingles 14, shown in detail in FIGS. 2 and 2*a*, are cut and folded from a sheet of metal and have three corner portions 17 of equal shape, cut off and discarded, and a fourth corner portion 18 of triangular shape is also cut off and discarded leaving parts of edge portions 19 and 20 on either side of central portion 21 of the shingle 14. The adjacent edge portions 19 are folded upwards and inwards along the chain-dot lines 22 to lie slightly spaced from and parallel with the central portion 21 of the shingle, while the two adjacent edge portions 20 are folded downwards and inwards along the chain-dot lines 23 to lie slightly spaced from and parallel with the central portion 21 of the shingle. The exposed corner 24 of the shingle 14 between the ends of adjacent upward facing edge portions 19 has a centrally located nail receiving aperture 25.

Figure 3:
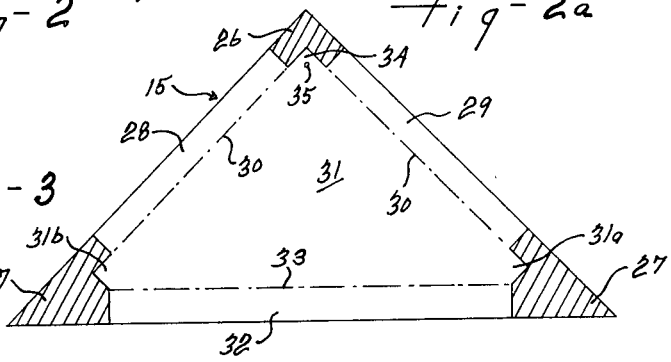
Figure 3A:
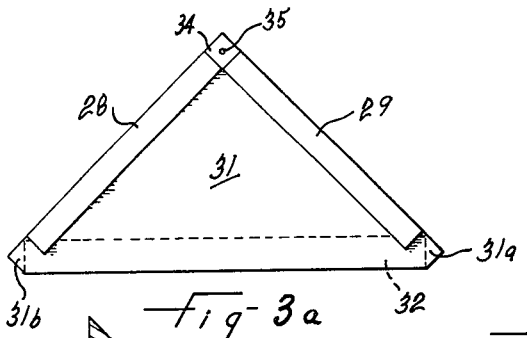

The eave starting shingles 15, shown in detail in FIGS. 3 and 3*a* are cut and folded from a sheet of metal having one corner portion 26 and two corner portions 27 cut off and discarded, leaving two edge portions 28 and 29 which are folded upwards and inwards along the chain-dot lines 30 to lie slightly spaced from and parallel with the surface of the central portion 31 of the shingle, while the remaining edge portion 32 is folded downwards and inwards along the chain-dot lines 33 to lie slightly spaced from and parallel with the surface of the central portion 31. The exposed corner 34 of the shingle 15 between the ends of adjacent upward facing edge portions 28 and 29 has a centrally located nail receiving aperture 35. The edge portion 32 has a greater width than the width of the edge portions 28 and 29 for engaging with an eave starter strip, as will be explained later.

Figure 4B:
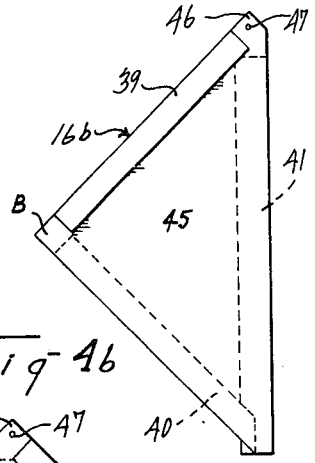
Figure 4:
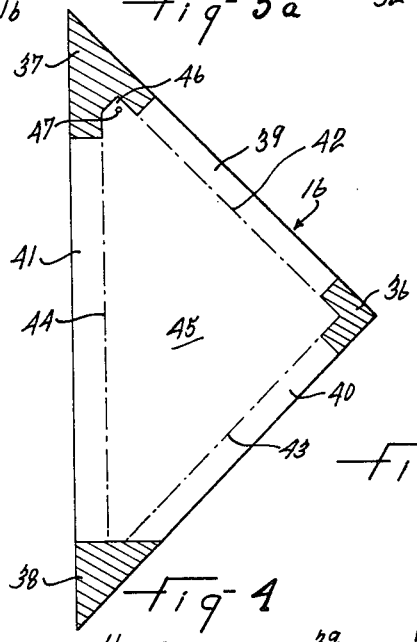
Figure 4A:
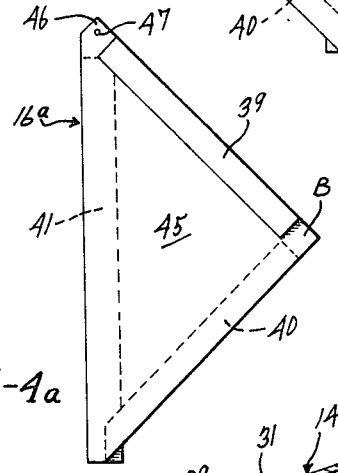
Figure 6:
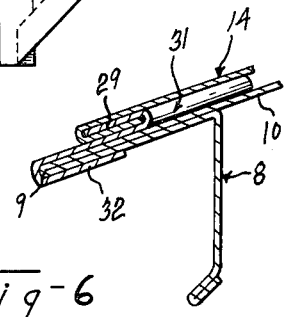
FIG. 6 is a transverse section taken on the line 6—6 of FIG. 3*a*.
Figure 5:
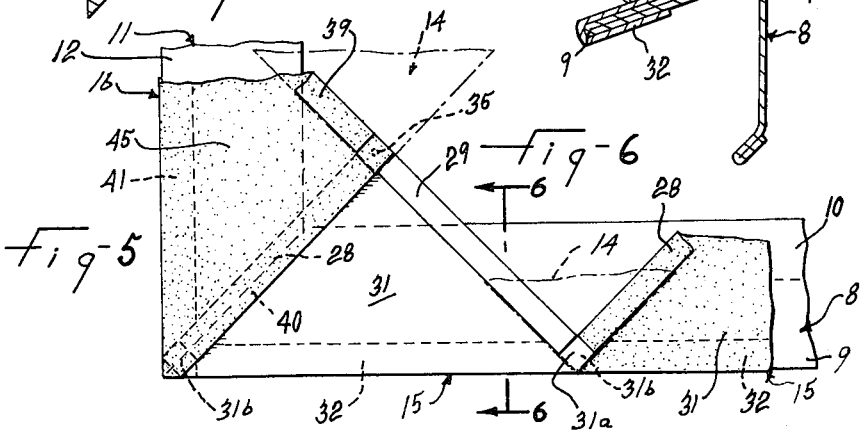
FIG. 5 is an enlarged top plan view showing the juncture area of an eave starter shingle, a gable end starter shingle and a square or rectangular shingle.
Figure 7:
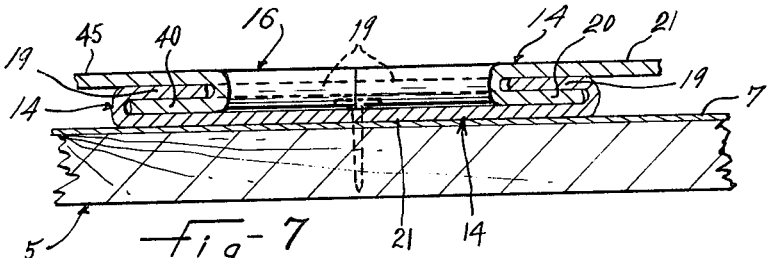
FIG. 7 is a transverse section taken on the line 7—7 of FIG. 3*a*.
Figure 8:
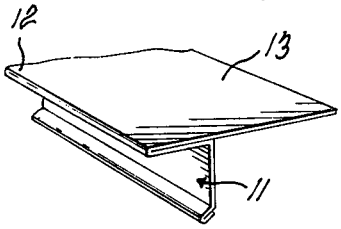
FIG. 8 is a perspective view of one end of the eave starter strip.
Figure 9:
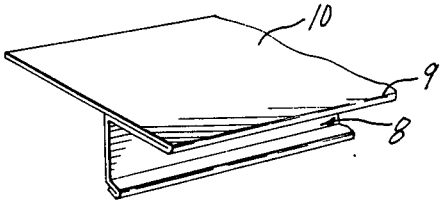
FIG. 9 is a perspective view of one of end of the gable end starter strip.
Figure 10:
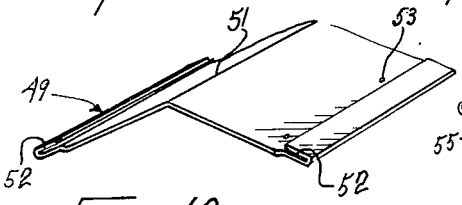
FIG. 10 is a perspective view of one end of the bottom member of the ridge cap.
Figure 11:
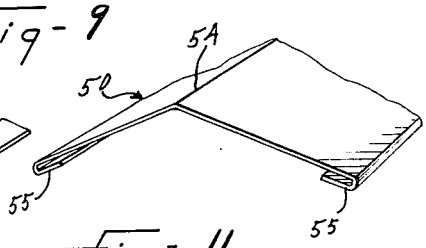
FIG. 11 is a perspective view of one end of the top member of the ridge cap.

The gable starting shingles 16*a*, shown in FIG. 4*a*, are designed for use at the left hand edge of the roof, a mirror picture of the shingle 16*b*, shown in FIG. 4*b*, is required for the right hand edge of the roof. The shingles 16 are cut and folded from a sheet of metal having one corner portion 36 cut off and discarded. The corner portion 36 of the gable starting shingle 16 is of the same shape and size as the corner portion 26 of the eave starter shingle 15. The remaining two corner portions 37 and 38 are cut to the shapes shown in FIG. 4 and are discarded, leaving three edge portions 39, 40 and 41. The edge portion 39 is folded upwards and inwards along the chain-dot lines 42 and the edge portions 40 and 41 are folded downwards and inwards along the chain-dot lines 43 and 44 to lie slightly spaced from and parallel with the surfaces of the central portion 45. The edge portion 41 has a greater width than the width of the edge portions 39 and 40 for engaging with a gable starter strip, as will be explained later. The exposed corner 46 of the shingle 16 at the adjacent ends of the edge portions 39 and 41 has a centrally located nail receiving aperture 47.

In order to complete the roof covering, a ridge cap 48 is provided to protect the upper edge portions of the uppermost end portions of the shingles 14 and 16 adjacent to the ridge of the roof. The ridge cap 48 consists of two sheet metal members, an under cap 49 and a sliding ridge cap 50. The under cap 49 is bent longitudinally along a central line 51 and extends downwards on either side of the ridge of the roof and has its lower longitudinal edges bent upwards and inwards in offset manner, as indicated at 52 in FIG. 12, and is secured to the underlying roof structure 5 by the nails 53.

Figure 12:
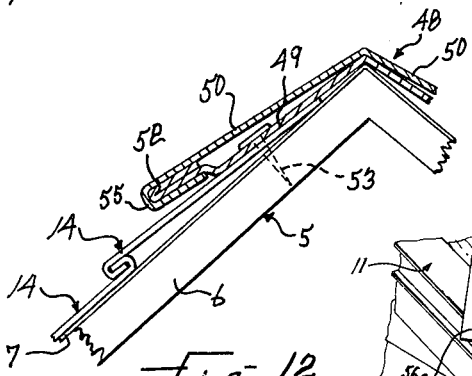
FIG. 12 is a transverse section of the ridge area of the roof, showing the two piece ridge cap and underlying roof structure.
Figure 1A:
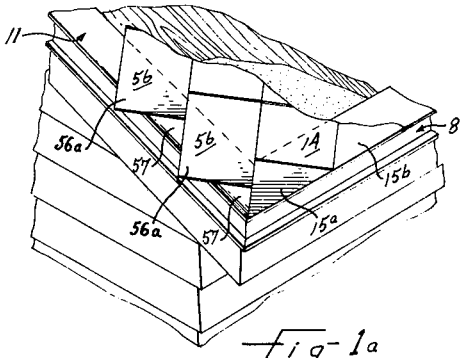

The sliding ridge cap 50 is bent longitudinally along a central line 54 and extends downwardly on either side of the ridge of the roof and has its lower edges bent downwardly and inwardly, as indicated at 55 in FIG. 12, and the inturned edges are adapted to make sliding contact with the offset upturned edges 52 of the under cap 49.

Where the length of the roof from gable end to gable end, including the protrusions 12 of the gable starting strips 11, is such that an even arrangement of square shingles and triangular shingles as shown in FIG. 1 cannot be made at the finishing end of the roof, the square shingles 14, interlocking with the triangular shingles 16, are replaced by rectangular shingles in the manner shown in FIG. 1*a*.

In FIG. 1*a* the lower ends of the elongated rectangular shingles 56 extend towards the protrusion 12 of the gable starter strip 11 and interlock with the triangular shingles 57 in the manner above described. Those portions 56*a* of the elongated rectangular shingles 56 and the triangular shingles 57 protruding beyond the outer edge of the protrusion 12 are trimmed to provide a folded under portion similar to the folded under portion 41 shown in FIGS. 4 and 4*a* for securing those portions 56*a* of the shingles to the protrusion 12 of the gable starter strip 11.

It is to be understood that the elongated rectangular shingles 56 can extend over the whole area of the roof within the bounds of the gable end and eave triangular shaped starter shingles instead of the square shingles 14.

INSTALLATION OF THE ROOF COVERING

After the wood roof structure has been cleaned, the eave starter strips 8 are secured to the lower edges of the roof, followed by covering the wood roof with sheet waterproof material 7. The gable starter strips 11 are then secured to each end of the roof.

The triangular eave starting shingles 15 are now installed along the lower edges of the roof over the eave starter strips 8, with the down turned lower edge portions 32 in locking engagement under the outwardly projecting portion 9 of the eave starter strips 8. The folded over edge portions 28 and 29 face upwards from the central portion 31 of the shingle. The right hand base corner 31*a* of one shingle 15 overlaps the left hand base corner 31*b* of an adjacent right hand shingle, as illustrated in FIG. 3*a*.

The eave starting shingles are successively secured in this interlocked position on the roof by driving a roofing nail through the apertures 35, located at the top corner 34 of each shingle.

Two forms of gable starting shingles are shown in FIGS. 4*a* and 4*b*. The one shown in FIG. 4*a* is for installation at the left hand gable end of the roof, while the one shown in FIG. 4*b* is for installation at the right hand gable end of the roof. First describing the installation of the left hand gable starting shingle 16*a* shown in FIG. 4*a*, the shingles 16*a* are installed from the bottom upwards towards the ridge of the roof, with their down turned edge portions 41 in locking engagement under the outwardly projecting portion 12 of the gable starter strips 11, with the edge portion 39 facing upwards from the central portion 45 of the shingle and the edge portion 40 facing downwards from the central portion 45.

The downwardly facing edge portion 40 of the lowermost shingle 16 interlocks with the upwardly facing edge portion 28 of the adjacent left hand end eave starting shingle 15. The gable shingle 16 in interlocking engagement with both the gable starter strip 11 and the adjacent eave starting shingle 15 is secured to the roof by driving a roofing nail through the aperture 47 at the uppermost corner 46 of the shingle.

In similar manner, the lowermost gable starting shingle **16*b*, shown in FIG. 4*b*, is installed in interlocking engagement with gable starter strip 11 at the right hand gable end of the roof and with the adjacent right hand end eave starter shingle 15 and is secured in place by driving a roofing nail through the aperture 47** at the uppermost corner of the shingle.

Succeeding upward progressing gable starting shingles **16*a* and 16*b* are interlocked with the gable starter strips 11 and their under-folded edge portions 40 are interlocked with the upwardly folded edge portions 39 of the adjacent lower gable starting shingles 16*a* and 16*b*** at each end of the roof.

Proceeding now to the installation of the main square form shingles 14, as shown in FIG. 1, and specifically with left hand shingles 14 which are interlocked with the adjacent eave starter shingles **15*a* and 15*b*, as shown in FIG. 1, the shingle 14 has one under-folded edge portion 20 interlocked with the upwardly folded edge portion 28 of the adjacent eave shingle 15*a* and its other under-folded edge portion 28 interlocked with the upwardly folded edge portion 28 of the shingle 15. The shingle 14 is secured in its interlocked position by driving a roofing nail through the aperture 25 in the upper corner 24** of the shingle.

The next succeeding shingle 14 to the right, as shown in FIG. 1, has its under-folded edge portions 20 interlocked with the upwardly folded edge portions 28 and 29 of the adjacent below eave starter shingle 15 and is secured in place by a roofing nail at its upper corner 24.

The shingle **14*a* at the next and succeeding upper row has one under-folded edge portion 20 interlocked with the adjacent upwardly folded edge portion 19 of the next below shingle 14, and has its under-folded edge portion 20 interlocked with the adjacent upwardly folded edge portion 39 of the lowermost gable starter shingle 16*a*, and having one upwardly folded edge portion 19 interlocked with the downwardly folded edge portion 40 of the next above gable starter shingle 16**.

All other shingles 14 in the central area of the roof have their downwardly folded edge portions 20 interlocked with the upwardly folded edge portions 19 of adjacent shingles 14 to complete the covering of the roof.

In similar manner, the elongated rectangular shingles 56, shown in FIG. **1*a***, can be installed over the whole area of the roof within the bounds of the triangular gable and eave starter shingles.

At the ridge of the roof, the topmost edges of the gable starter shingles 16 and the shingles 14 are cut at approximately 1½ inches from the ridge of the roof.

The under cap 49 is now placed along the ridge of the roof and is secured in place on either side of the ridge by the roofing nails 53 which also secure the uppermost edges of the gable starter shingles 16 and the shingles 14.

The ridge cap 50 can now be slid longitudinally over the under cap 49 with the under-folded longitudinal edge 55 in interlocking engagement with the upwardly folded longitudinal edges 52 of the under cap 49.

The ridge cap 50, if made of sections, should have the adjacent ends of the sections overlap and the edges sealed with mastic.

With the interlocking of the shingles as above described, all mating corners of shingles are overlapped so as to present an upper surface of the roof covering composed only of the central portions 21, 31 and 45 of the shingles. This has the effect that the edges of these surfaces 21, 31 and 45 form continuous lines running at 45° from the eave and gable ends of the roof up to and under the roof cap 48. These continuous 45° lines are indicated by the letter A in FIG. 1. The continuous lines A are unbroken even at the lower corners **21*b* of the shingles 14 due to the fact that the mating edges of the two edge portions 20 are cut sufficient only to the thickness of metal forming the corner 21*b*** and not through the metal at this point.

The overlapped mating corners of the interlocked shingles are so arranged that the corner portions 24 of the square shingles 14, the corner portions 34 of the eave starting shingles 15, and the corner portions 46 of the gable starting shingles 16 are lowermost against the underlying roof structure 6 and 7 and the heads of the roofing nails securing these corners 24, 34 and 46 are covered by a blank corner such as the blank corners B shown in FIGS. **2*a*, 4*a* and 4*b*, covering the roofing nail head 25 (FIG. 2*a*), 35 (FIG. 3*a*) and 47 (FIGS. 4*a* and 4*b*), and the blank corner B being covered by the underlying mating lower ends of the edge portions 20 and the lower portions 21*a* of the top surface 21, FIG. 2*a*. By accurate cutting of the corner portion 18, FIG. 2, the edge portion 21*b*** is maintained solid and does not expose an opening for the entry of wind driven water. All other edge portions of mating shingles are protected against the entry of water by the labyrinth construction of the interlocking edge portions of the mating shingles.

The result is a pleasing arrangement of shingles on a roof whose edges are disposed at an angle from the eave and gable ends of the roof up towards the ridge of the roof and presenting only a series of flat surfaces with clearly defined edges having no apparent overlap of interlock with each other.

The embodiments of the invention in which an exclusive property or privilege is claimed are defined as follows:

1. A roof covering for a roof under structure comprising roof eave starter strips and gable end starter strips formed of sheet metal and secured to the said under structure and a series of shingles formed of sheet metal including triangular shaped eave starter shingles and triangular gable end starter shingles, the said eave and gable starter shingles each having one edge portion interlocked with an edge portion of adjacent eave and gable starter strips and each being secured at an upper corner thereof by a roofing nail to the underlying roof structure, and a series of four sided shingles covering the area of the roof between the said eave and gable starter shingles, the said four sided shingles adjacent to the said eave and gable starter shingles having their edge portions interlocked with adjacent edge portions of the said eave and gable starter shingles and the remaining four sided shingles each having their edge portions interlocked with the edge portions of adjacent four sided shingles, and having their uppermost corners secured by a roofing nail to the underlying roof structure, the said eave, gable and four sided shingles having their edges forming continuous unbroken lines disposed at an angle of 45° from the eave and gable ends of the roof towards the ridge of the roof, and a ridge cap covering the uppermost edge of the said assembled shingles.

2. A roof covering as set forth in claim 1 in which the said eave and gable end starter strips have a lengthwise folded protrusion projecting outwardly at the level of the said roof under structure and the said triangular eave and gable starter shingles each have one edge thereof folded under and inwards for interlocking engagement with the folded protrusions of the said eave and gable end starter strips.

3. A roof covering as set forth in claim 1 in which the two edges of the triangular eave starter shingles, opposite from the folded under edge, have an intermediate portion thereof folded upwards and inwards to lie spaced from and parallel with the plane of the body of the shingle.

4. A roof covering as set forth in claim 3 in which corner portions of the eave starter shingles beyond the ends of the intermediate folded over edge portions are a single layer of sheet material, and the corner portion opposite from the folded under one edge has a centrally located aperture to receive a roofing nail.

5. A roof covering as set forth in claim 2 in which one edge of the triangular gable starter shingles, opposite from the folded under edge engaging with the said folded protrusion of the gable starter strip, has an intermediate portion thereof folded upwards and inwards to lie spaced from and parallel with the plane of the body of the shingle and the other one edge of the triangular gable starter shingle has an intermediate portion thereof folded downwards and inwards to lie spaced from and parallel with the plane of the body of the shingle.

6. A roof covering as set forth in claim 5 in which corner portions of the gable starter shingles beyond the ends of the intermediate folded over edge portions are a single layer of sheet material and the corner portion adjacent to the folded under edge portion engaging with the protrusion of the gable end starter strip and the adjacent folded upward edge portion has a centrally located aperture to receive a roofing nail.

7. A roof covering as set forth in claim 1 in which the said four sided shingles have intermediate portions of two adjacent edges thereof folded upwards and inwards to lie spaced from and parallel with the plane of the body of the shingle, and the two other adjacent edges of the shingle have intermediate portions thereof folded downwards and inwards to lie spaced from and parallel with the plane of the body of the shingle.

8. A roof covering as set forth in claim 7 in which the two adjacent edges of the shingle which are folded downwards and inwards have their mating end portions out at an angle to abut each other.

9. A roof covering as set forth in claim 7 in which the corner portion of the shingle opposite from the angled and abutting end portions has a roofing nail aperture therethrough.

10. A roof covering as set forth in claim 7 in which the said shingles are secured to the underlying roof at their uppermost corners and have their edge portions disposed at an angle to roof gables and eaves, and the downwards and inwards folded edge portions of the shingles are in interlocking engagement with the upwards and inwards folded edges of the next below adjacent shingles.

11. A roof covering as set forth in claim 2 in which the said rectangular shingles at the end of the roof remote from the gable starting shingles are interlocked with the adjacent gable end shingles and portions of the rectangular shaped shingles and said gable end shingles protruding beyond the adjacent gable end starter strip are hand formed to engage under the folded outwardly projecting protrusion of the adjacent gable end starter strip.

12. A roof covering as set forth in claim 1 in which the said ridge cap is in two longitudinal parts, a first under part being secured by roofing nails passing through the uppermost of the shingles on the roof and to the underlying roof structure, and a second part has longitudinal edge portions in longitudinally sliding engagement with the longitudinal edge portions of the said first under part.

13. A roof covering as set forth in claim 1 in which the said ridge cap is in two longitudinal parts, a first part having its longitudinal edges folded upwards and inwards and upwardly off-set from its main body portion and being secured by roofing nails passing through its main body portion and through the uppermost shingles on the roof to the underlying roof structure, and a second part of the roof cap has longitudinal edge portions turned downwardly and inwardly for sliding engagement with the offset folded edge portions of the said first part of the ridge cap.

14. A roof covering as set forth in claim 1 in which the said rectangular shingles are of square form.

15. A roof covering as set forth in claim 1 in which the said rectangular shingles are of elongated form.

* * * * *